United States Patent [19]

Schmitt (Johnston)

[11] 4,282,733

[45] Aug. 11, 1981

[54] FINGER-RETAINED KEY HOLDER ASSEMBLAGE

[76] Inventor: Dorothy D. Schmitt (Johnston), 4138 Eagle Rock Blvd., Los Angeles, Calif. 90065

[21] Appl. No.: 964,788

[22] Filed: Nov. 29, 1978

[51] Int. Cl.[3] ..... A47G 29/10

[52] U.S. Cl. ..... 70/456 R

[58] Field of Search ..... 70/456 B, 456 R, 457, 70/458, 459; 24/31 K, 211 R; 150/40; 224/28 E, 28 C, 28 F

[56] References Cited

U.S. PATENT DOCUMENTS

| | | | |
|---|---|---|---|
| 2,114,266 | 4/1938 | Bodor | 70/456 R |
| 2,292,563 | 8/1942 | Imhoff | 70/458 |
| 2,453,190 | 11/1948 | Boscowitz | 70/456 R |
| 3,804,307 | 4/1974 | Johnston | 70/456 R |
| 3,823,587 | 7/1974 | Tcherdakoff | 70/456 R |

*Primary Examiner*—Robert L. Wolfe
*Attorney, Agent, or Firm*—Laforest S. Saulsbury

[57] ABSTRACT

A finger-retained key holder assemblage has been provided that will prevent the loss of keys when carrying the keys in the hand as in the dark or carrying bundles without having to close the fingers about the keys in the palm of the hand. This key assemblage is secured to the hand by a ring placed upon the third finger or by a button, disk or clip extended over two fingers, a chain depending from the disk and squeezed by the two fingers and a key-supporting bar lying under the fingers and clamped thereto. Keys are loosely suspended from the underside support bar. While the flexible assemblage is secured to the third finger or between fingers, an individual key can be easily selected and grasped by the thumb and forefinger of the same hand and made ready for use for projection into a key hole. As well, the fingers can be closed comfortably about the assemblage to further safely retain the keys in the hand. The overall length of the assemblage has been kept to a minimum so that the keys can be easily reached by thumb and finger to select the key and aim it toward a key hole, thrust it home and turn the lock, all without loss of the keys. The assemblage can include the finger ring or made to be clipped or detachably attached to the bottom of the band of any ring normally worn on the third finger of the hand for ornamental purposes. The key support bar thus can be made as a separate assembly and simply attached to any ring that stays on the finger whereby the need to provide different size rings for the assembly to fit a user's finger is easily eliminated. The ring assembly thus is usable with either a tight fitting ring or a loose fitting ring. Likewise, the button, disk or clip for the top of the two fingers can be of any style or ornamentation and preferably in the form of a clip so that the assemblage can be attached to the side of a pocket. Both the ring and disk has means for hanging the assemblage upon a wall hook when not in use. Both the ring and disk has means for retaining a coin.

13 Claims, 23 Drawing Figures

Figure 1:
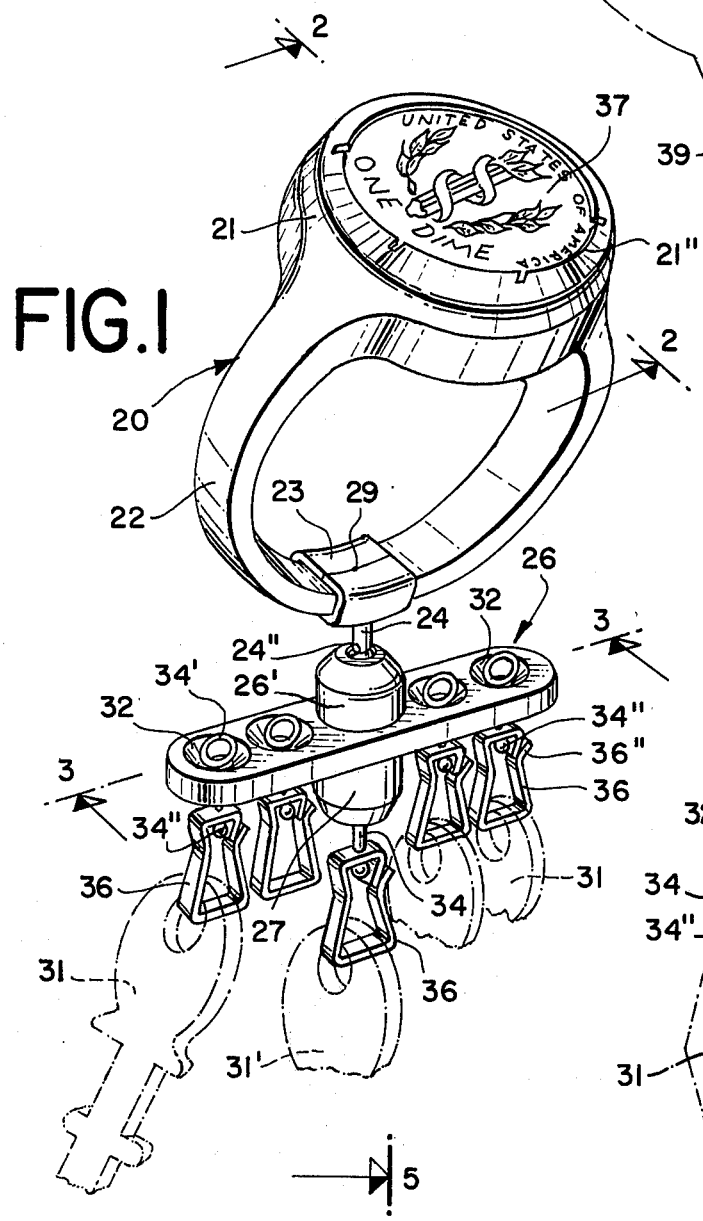

FIG.6
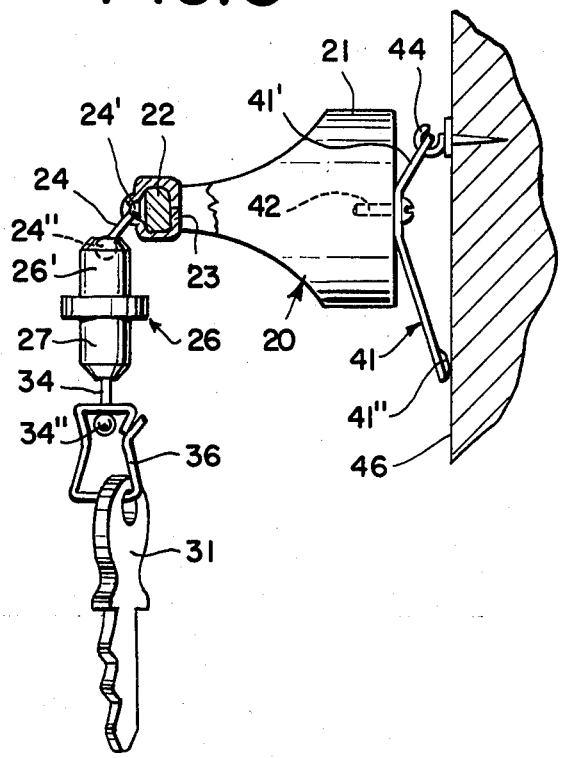
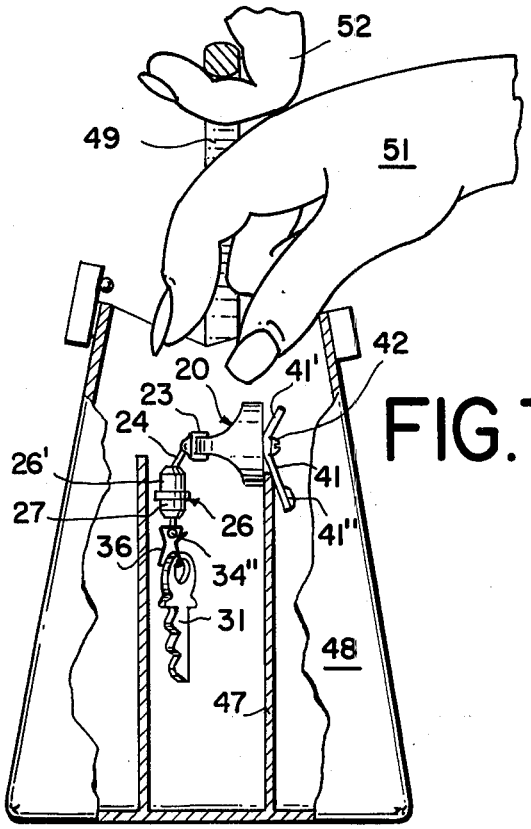
FIG.7
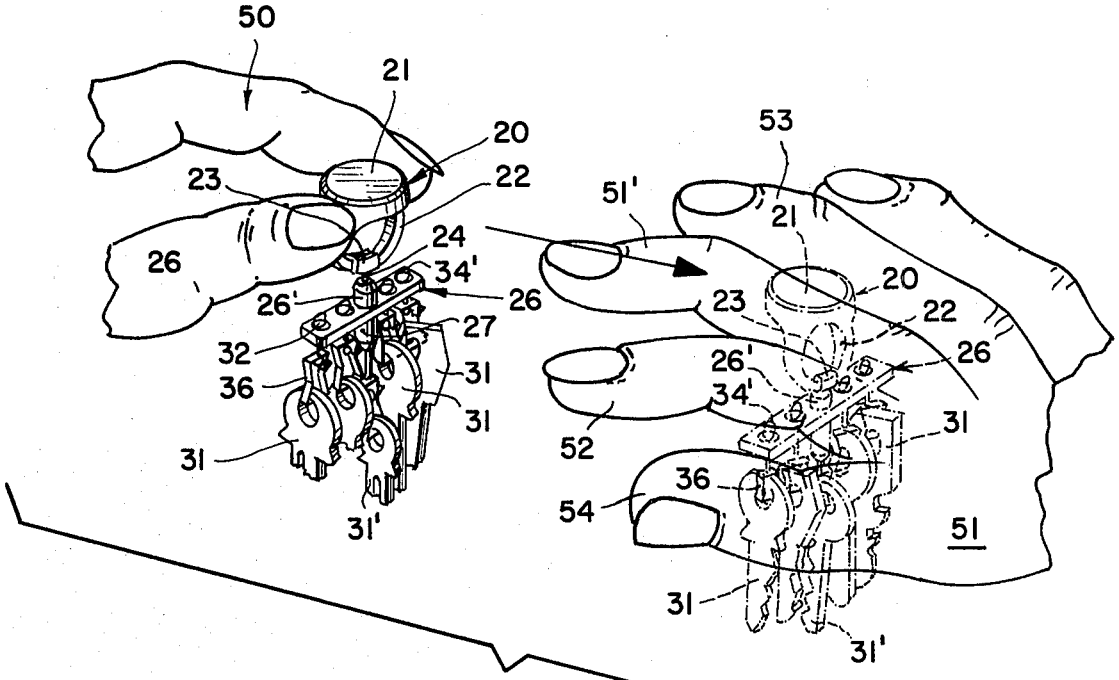
FIG.8

FIG.9
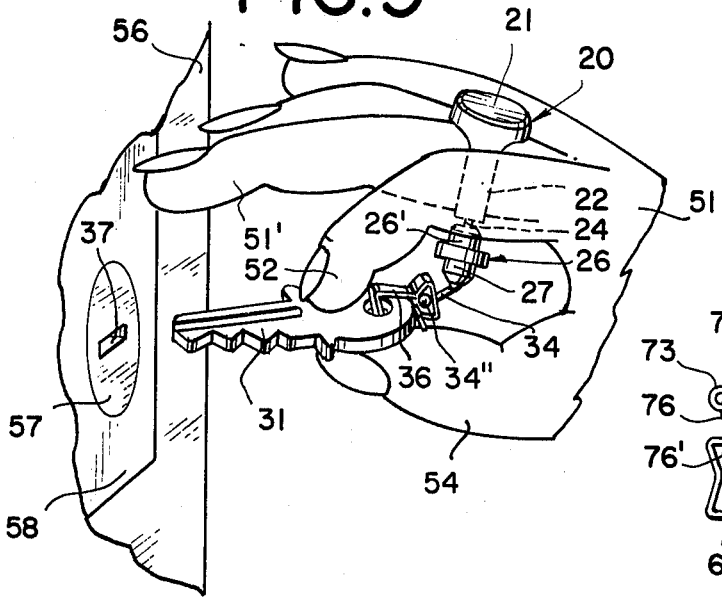
FIG.10
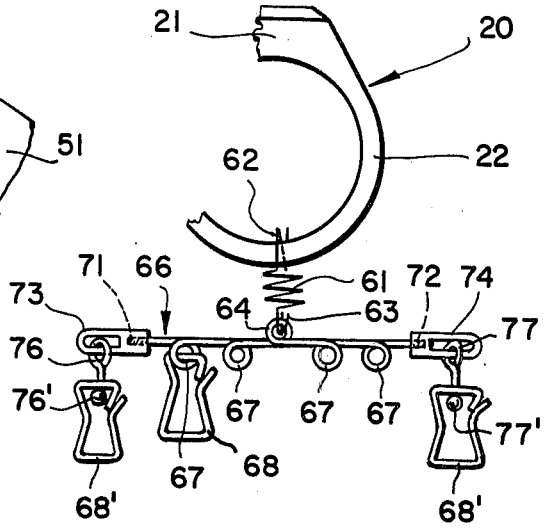
FIG.11
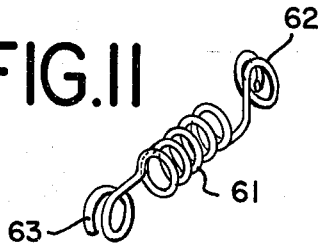
FIG.12
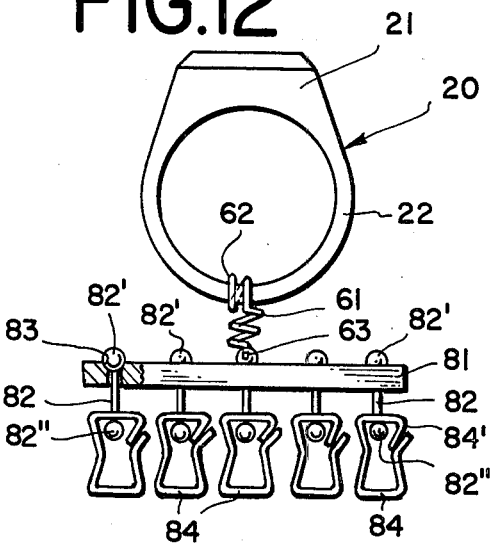
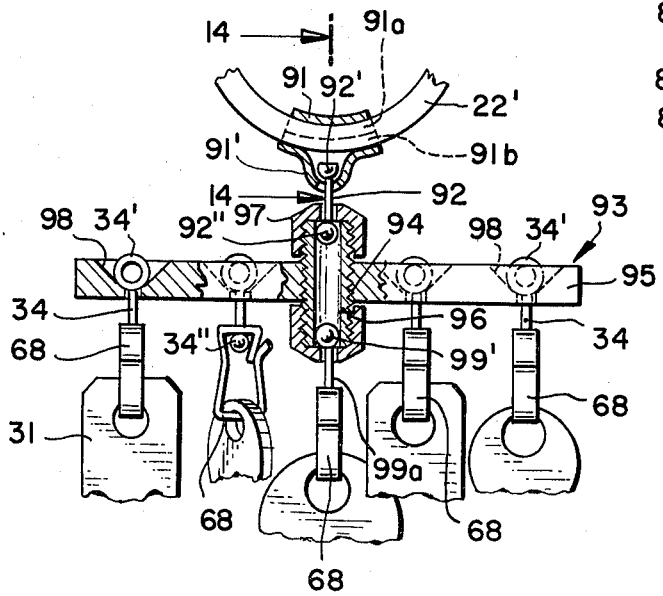
FIG.13
FIG.14
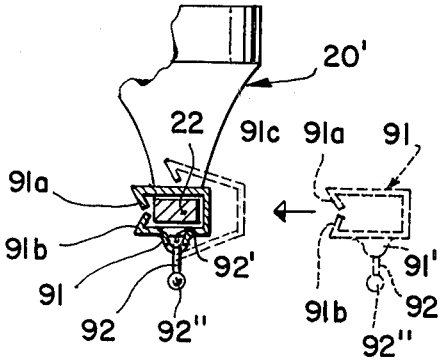

FIG.19
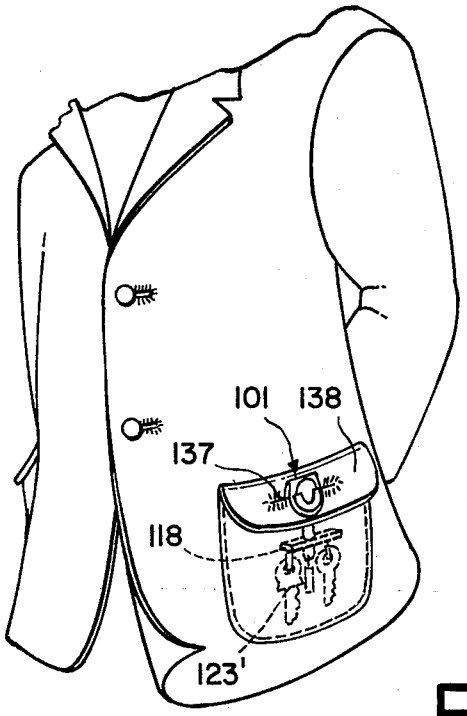
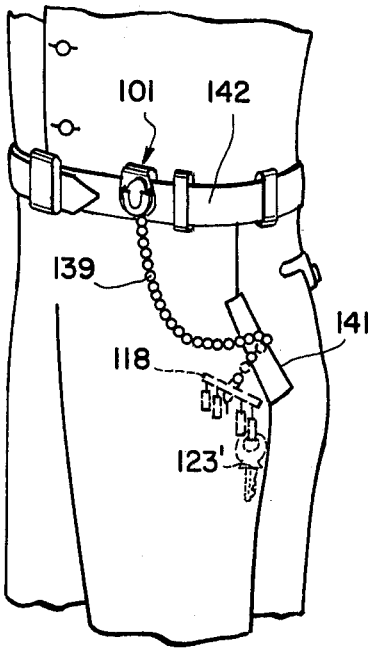
FIG.20
FIG.22
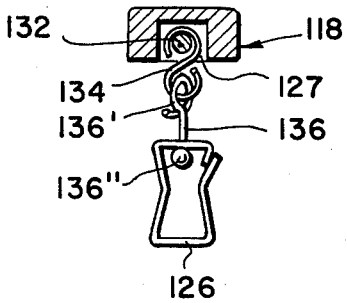
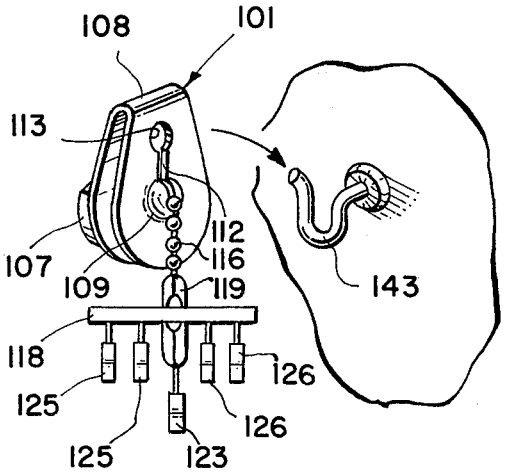
FIG.21
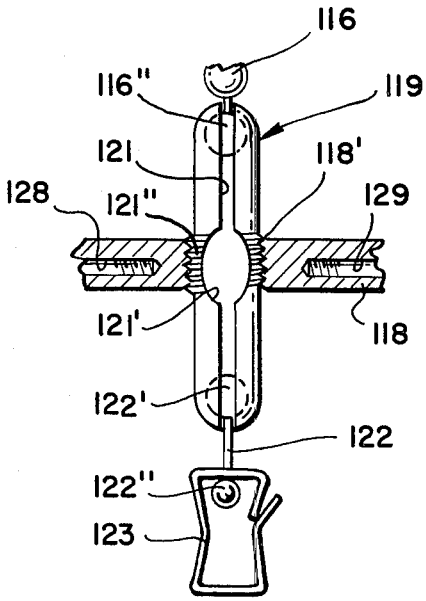
FIG.23

FINGER-RETAINED KEY HOLDER ASSEMBLAGE

This invention relates to a finger-retained key holder assemblage similar in type to the key holder of my Pat. No. 3,804,307, issued Apr. 16, 1974, under my name then of Dorothy D. Johnston and prior to my recent marriage to Raymond E. Schmitt.

It is the principal object of this invention to provide a key holder assemblage that will be held safely in the one hand to which it is attached by a ring on the third finger or disk with chain between fingers and while being so attached in the one hand that one of the keys can be easily selected by the thumb and finger of the same hand and manipulated into a key opening without the key holder assemblage being dropped or lost from the hand and so that the hand can still be kept free to handle packages.

It is another object of the invention to provide a finger-retained key holder in which the stem for the attachment a transversely-extending key support bar to finger ring band may not only swivel, but is flexible and stretchable in form of a spring that may stretch to allow the key on its support bar to be within easy reach of the forefinger and thumb, to allow the key to be thrust by the swivel or stretch of the spring as the thumb and forefinger are straightened to insert the key in the door keyhole and yet the key assemblage prevented from release of the hand, the assemblage being always in tact with the finger of the hand without the need of the assemblage being pressed into the hand.

It is another object of the invention to provide a flexible finger-retained key holder assemblage that will, as with my originally patented ring key holder, have a solitary automobile or special key clip that is detachable and separable from the underside or an end of the multiple key support bar, that cannot only be detached so that car keys being a part of the key assemblage can be easily separated from the holder and left in the car for use by an attendant at a parking lot or to another driver while the other keys and key assemblage may be taken from the car free of the car keys in the safe manner held by the fingers and manipulated by the thumb and forefinger.

It is still another object of the invention to provide a finger ring disk and chain for a finger-retained key holder assemblage that has an enlarged head with auxiliary features to give the ring or disk themselves further use as for hanging the key assemblage on a wall hook, clipped to a handbag or for use as small coin or bus token dispenser.

It is still another object of the invention to provide a finger-retained key holder assemblage, which, instead having a stem connected rigidly to the bottom of the ring band and to the elongated crosswise key supporting bar and in one rigid or stiff assembly as shown in my prior patent but is provided with an assemblage of the ring or disk and bar that includes a stem with a swivel connection or joints to allow the key bar to be folded fore and aft, up and down of the ring or disk and to laterally swing when on the fingers so that a key is so strung from the bar that it can be easily reached with thumb and forefinger, grasped and thrust into a keyhole on a door while the ring or disk remains on the fingers and without requiring use of the other hand or the possibility of keys being fumbled or dropped during the unlocking and opening of a door as at a time when bundles also are being carried in the arms and hands.

It is a further object of the invention to provide a finger-retained key holder wherein the overall vertical height of the key assemblage and the keys dangling from along the transverse key support bar, when the ring or disk is retained by the fingers, need not be so extended and the suspended key placed out of reach of the thumb and forefinger and that there need by any assistance from the other hand and to eliminate the need for the long extensible depending chains and clips for the individual key as in my prior ring key holder and but wherein dependency is made upon the swivel and loose connection of the key support bar with the ring band or disk for making the key available to the thumb and forefinger.

It is still a further object of the invention to provide a finger-retained key assemblage in use of a standing ball strung key chain and clasp that can be used in the attachment of the finger-retained disk and which can be made selective as to any length and the disk made in the form of a clip that can be used with a long chain for allowing the keys and support bar to be dangled in the pocket while the clip disk is fastened to the edge of a trouser pocket or a trouser belt, thereby allowing a long chain and the keys to be extended from the pocket as well as from the fingers.

Still futher objects of the invention are to provide an improved finger-retained ring or disk type key holder having the above objects in mind, which will be inexpensive to manufacture of simple construction, easy to assemble upon the finger rings or disks, that makes it easy to attach and detach the keys themselves, of pleasing appearance, light in weight, effective and efficient in use.

Figure 2:
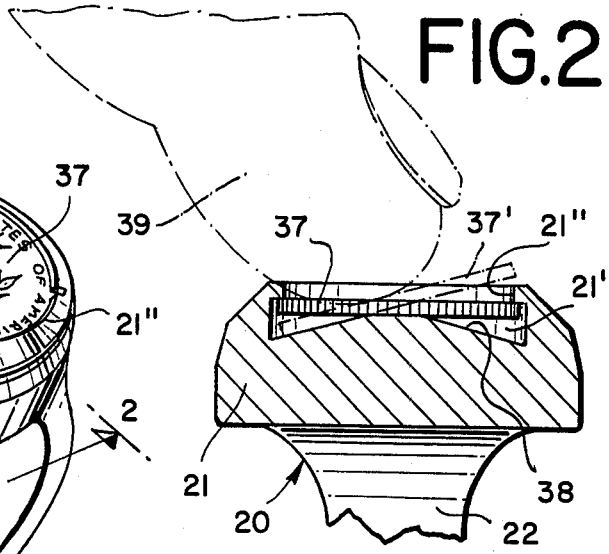
Figure 3:
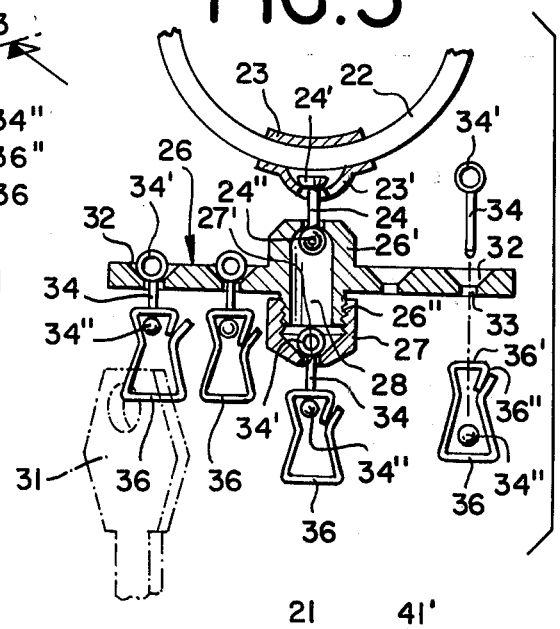
Figure 4:
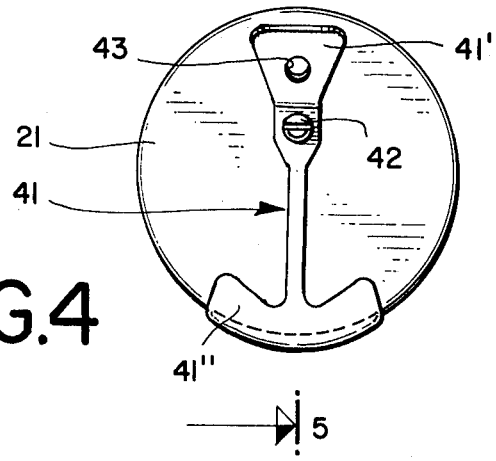
Figure 5:
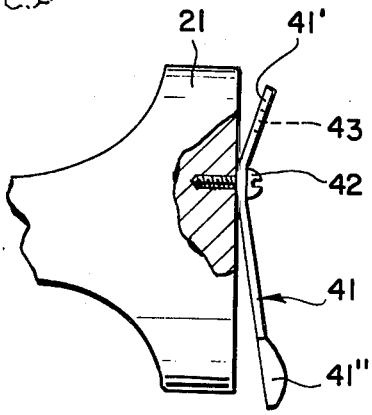
Figure 15:
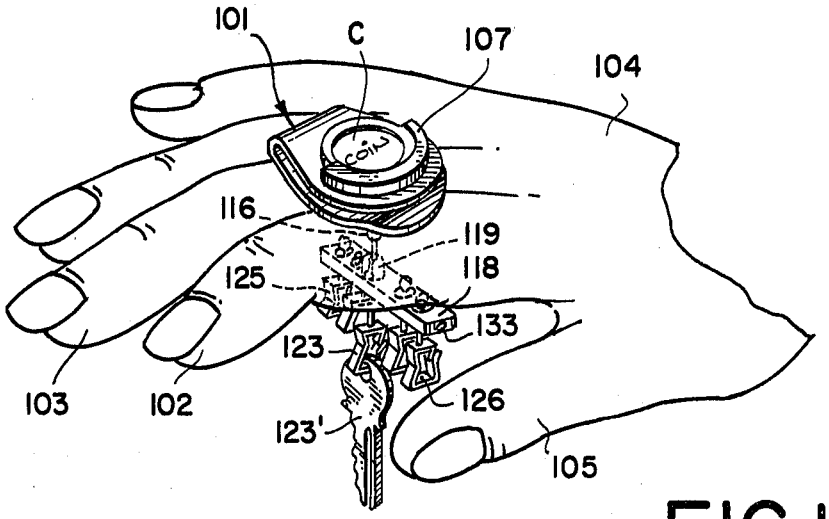
Figure 17:
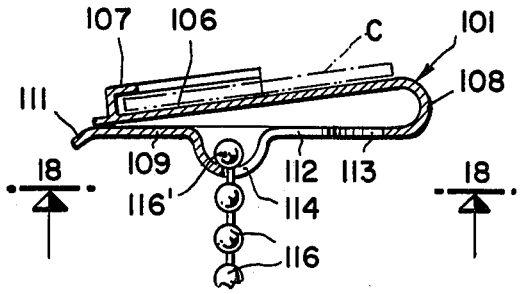
Figure 17:
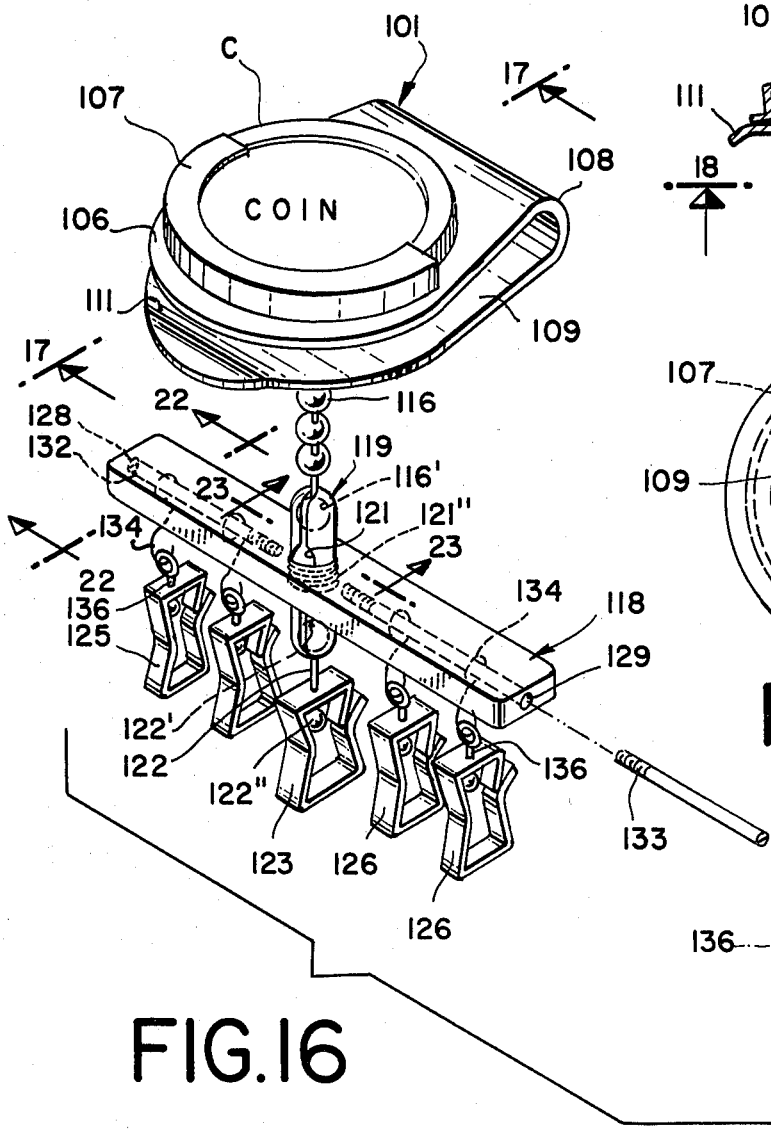
Figure 16:
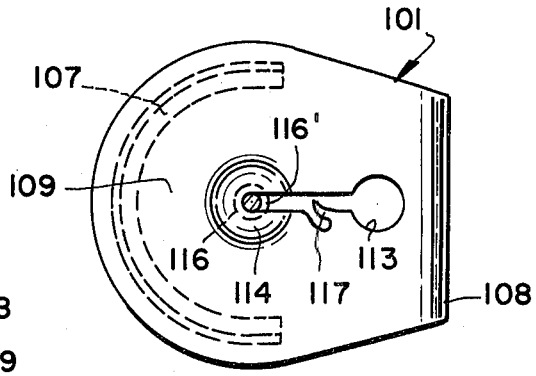
Figure 18:
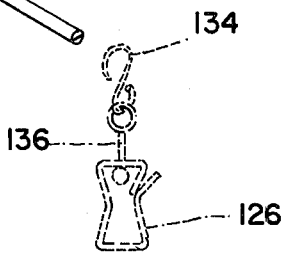

For a better understanding of the invention, reference may be had to the following detailed description taken in connection with the accompanying drawings, in which FIG. 1 is an enlarged perspective view of the finger-retained key holder assemblage having the support bar assembled by its swivel stem upon a finger ring band and swivel mounted key-supporting clips depending from support bar for receiving the keys and a central detachable clip for separably supporting the automobile keys to the key support bar, FIG. 2 is a fragmentary sectional view of the finger ring head as viewed on line 2—2 of FIG. 1, the head being adapted to contain coins with an illustration made by the showing of a finger as to how the coin can be tilted out of and dispensed from the ring head, FIG. 3 is a fragmentary transverse sectional and collective view of the key clip supporting bar with its swivel stem fastened to a bottom fragment of the ring band and showing in section the interior of the depending central threaded attaching portion, cup-shaped element for detachably supporting the car keys clip on the main key support bar with illustration made of the manner of the assembling of the swivel connection of the depending key clips with the key supporting bar, FIG. 4 is a front face view of the ring head itself looking in plan upon the hanger and pocket clip structure for storing the entire finger ring key holder assemblage on a hook or pocket partition when not applied to the ring finger, FIG. 5 is a fragmentary vertical view of the ring by itself with a portion of the ring head as viewed generally on line 5—5 of FIG. 4, to show the clip structure screw connected thereto, FIG. 6 is a side elevational view of the finger ring key holder assemblage suspended by its head clip structure from a wall hook, with a portion of the ring band broken away to show the swivel stem clip attached thereto, FIG. 7 is a fragmentary sectional view of a ladies' handbag with a portion broken away to show a ring key holder assemblage hooked over one of the handbag partitions and with hands illustrating how readily access to the bag is had for obtaining the keys, FIG. 8 is a collective and perspective view of the ring key holder assemblage with illustration being made of the key holder assemblage being held in one hand and slid over the third finger of the other hand to be supported therefrom as in dotted line position thereon under the hand with the supporting bar and keys depending in position to be gripped by the other fingers and drawn into the palm of the hand or when left suspended to permit the thumb and forefinger of the hand and to make for an easy selection of a desired key, FIG. 9 is a collective and perspective view of a door fragment with a keyhole lock and of the ring key holder on the one hand and with a key having been selected from the holder assemblage by the forefinger and thumb of the hand and being extended toward the lock keyhole, and bundles that will have been remained mainly supported in the other hand and will need not have been released to put the key in the keyhole by the one hand to unlock and open the house door, FIG. 10, first sheet, is a fragmentary elevational view of a finger ring key holder assemblage constructed according to a modified form of the invention with the key supporting bar made of bare wire stock and with the connection of the keys made to the supporting bar, ring band by loops in the wire and threaded disconnectible end key loops and a tension coil spring replacing the double swivel stem of FIGS. 1 and 3, to give extensible as well as swivel action, FIG. 11 is a perspective of the extensible tension coil spring of FIGS. 10 and 12 separate and apart from the assemblages with its ends coiled for detachable connection with the ring and with the key support bar, FIG. 12 is a front elevational view of another modified form of the invention of a ring key holder assemblage with the connection of the key support bar being made to the finger ring band by the same tension coil spring of FIGS. 10 and 11, but the key support bar being made from a straight standard stock bar piece and with no individual key detachment and probably the most simple of all forms, FIG. 13 is a fragmentary front elevational view of still another modified form of the invention in which finger ring key holder assemblage is fabricated from threaded pieces assembled to one another with ball-headed swivel rods and being releasably attachable to any ring band from sidewise direction by a forced spring clip to hold the double ball stem connection for the support bar, the ring being the one normally worn by the owner at all times, FIG. 14 is a fragmentary and vertical sectional view of any such worn ring and of the clipwise key assemblage of FIG. 13 as viewed on line 14—14 thereof, with illustration showing how the clip is forced sidewise onto and over the ring band, FIG. 15 is a perspective view of a still further modified form of the invention with the key assemblage, rather than being depended from a ring supported on a finger of the one hand is retained by a button, disk or clip overlying the top of two fingers with a ball chain depending therefrom and squeezed by the fingers so that key will be support bar with the keys pressed up against the underfaces of the fingers, FIG. 16 is an enlarged perspective and collective view of the key assemblage of FIG. 15 removed from the hand and showing more clearly the several parts of the assemblage and how these parts are assembled to one another, FIG. 17 is a sectional view of the disk clip with a portion of the ball chain depending therefrom as viewed on line 17—17 of FIG. 16, FIG. 18 is a bottom plane view of disk clip used with this latter form of the invention showing the keyhole opening for releasably receiving a chain ball of the key chain portion, FIG. 19 is an illustrative view of how this key assemblage form can be suspended from a lower side pocket of a man's jacket with the key assemblage lying safely within the pocket, FIG. 20 is also an illustrative view showing this disk clip fastened to trouser belt but with a long key chain with the key support bar and keys extended loosely into a side leg trouser pocket for easy access thereto, FIG. 21 is a collective and perspective view of a disk clip key bar assemblage about to be placed upon a wall hook as when not needed upon the person, FIG. 22 is a transverse sectional view of an individual key clip attached to swivel depending from the underside of the key support bar, the view being taken along line 22—22 of FIG. 16, FIG. 23 is a fragmentary sectional view of the assemblage taken on line 23—23 of FIG. 16 showing in particular the thread connections of the ball chain fastener depending into the key support bar to keep it from separation therefrom, the connected end ball of the chain and the ball rod attaching the central auto key clip into the assemblage being assembled to the support bar thereby.

As various forms of the invention are to be described, it should be understood that the parts will be such as to permit sufficient swivel movement of the finger-retained key holder support bar and the access to the keys suspended therefrom so that the selected key can be extended forwardly from the finger ring or disk, by the thumb and forefinger of the same hand and easily aimed at the door keyhole and that the overall vertical length of the finger key holder with keys are shortened such that the individual keys will be easily accessible to the thumb and forefinger of the hand while holding the ring or disk by the fingers.

Referring now to FIGS. 1, 2 and 3, 20 represents a finger ring made especially for the key holder that has an enlarged head 21 and a depending band portion 22 over which is permanently clipped a closed sleeve 23 to hold a dual swivel stem rod connection 24. This stem rod 24 has a small half swivel ball head 24' lying within the closed sleeve 23 and a large full swivel ball head 24'' at its lower end to which a transverse key support bar 26 is attached for fore and aft and swivel movement.

The closed sleeve 23 is generally of rectangular cross-section and preferably slightly curved from end to end to conform to the longitudinal curvature of the bottom of the ring band and thereby held against rotation thereabout. The bottom of the closed sleeve is depressed to provide a socket formation 23', FIG. 3, by which an enlarged semi-spherical or half-ball head 24' of the dual swivel stem rod 24 is connected to have swivel movement therein with diameter of its bottom hole being large enough to allow such movement yet without disengagement therefrom.

The key support bar 26 is formed of cast metal and has a central, hollow, rounded top or socket formation 26' for housing swivel ball formation 24'' of dual swivel connection stem rod 24 and with its outlet hole being of a diameter more larger than the normal diameter of the stem rod 24 to allow considerable swivel movement between the stem 24 and the key support bar, all with the idea of permitting the assemblage to be folded into the palm of the hand while the finger ring 20 is in place on the third or any finger of the hand and the key easily selected by the thumb and forefinger in the manner illustrated in FIG. 9. Vertically-aligned with the top socket formation 26' and depending from the bottom side of the key support bar 26 is a depending externally-threaded tubular portion 26'' to which an internally-threaded cup 27 is detachably connected for a purpose soon to be set forth. A hole 28 of slightly larger diameter than the lower rod ball formation 24'' of the dual connecting swivel stem rod 26 extends upwardly and internally and is rounded at its upper end to accommodate the lower rod ball head 24'' but terminating with a smaller hole of which to allow the smaller diameter half-ball head 24' of stem rod 24 to pass upwardly through socket formation 26'. The closed sleeve 23 has the socket formation 23' into which small half-ball 24' of the stem will have been inserted and the sleeve swaged to provide and retain stem head 24' so that it can swivel in the closed sleeve socket formation 23'. To permit this swaging operation of the small head 24', the closed sleeve 23 may have been made from a foldable metal sheet with the ends abutting one another at 29, FIG. 1. The closed sleeve 23 may be folded onto the ring band 22 simply by use of swaging dies, or sprung thereover if the sleeve has been separately made of spring material, but in either case so constructed that there will be provided a good swivel connection of the stem half-ball 24' of the stem rod 24 and the closed sleeve socket formation 23'. However, the key supporting bar 26, the swivel stem or rod connection 24, the closed sleeve 23 and the ring band 23 can be assembled in any suitable manner so that it can supply adequate loose play for the selecting of the key and use of the key by the thumb and forefinger of the one hand.

The key supporting bar 26 is further fashioned to provide for the swivel mounting thereon of individual keys 31, FIG. 1. To effect this, the top surface of the bar 26 is provided with four depressed rounded out ball-receiving surfaces 32 from the bottom of which there is extended small-diameter drain-like holes 33 downwardly through which there are extended less diameter swivel links 34 with their shanks extending loosely through the small holes 33 and their circular-shaped bent heads 34' lying for free swivel motion of the links 34 below the bottom face of the key support bar 26. After the links 34 have been extended through their holes 33 in the key support bar 26, key-retaining clips 36 are slid onto the link shanks 34 and extended into small holes 36', FIG. 3, in the lateral top portions of the key clips 36 and the clips held upon the link shanks by upsetting or enlarging the lower ends of the link shanks as shown at 34''. Thus, links 34 and the key clip 36 will all be held loosely to swivel upon the transverse key support bar 26 the same as the key support bar 26 is in turn held loosely and for fore and aft and swivel movement relative to the finger ring 20 and if the entire finger ring 20 is slightly oversized, the ring itself can be tilted fore and aft on the mounting finger of the one hand, all to give the adequate stretch that may be needed to select the place a key 31 in the door keyhole 37, FIG. 9, from the one hand that carries the entire key assemblage safely up the finger. The key clips 36 and the retaining links 34 are not removable from the bar 26 but only the keys 31 that may have been assembled upon the clips 36 through their slits 36'' can be detached or replaced as desired.

There will be two such swivel link and key clip assemblies at each side of the top central socket formation 26' of the key support bar 26. Each key clip 36 can hold one, two or even more keys 31 and each key will be accessible to the thumb and forefinger while the ring 20 is fitted upon the third or other fingers of the hand, FIGS. 8 and 9. With this link and key clip assembly, such long chains and key clips of my U.S. Pat. No. 3,804,307 on which depending keys thereof were extended rather unreachable by thumb and forefinger of the hand while keeping such a ring on the third finger or other fingers but more or less requiring the use of the other hand to pretty much locate the key with the thumb and finger of the one hand but pretty much necessitated the use of the other hand. My prior assemblage with the grid stem and key supporting bar was too long and manipulation of the key from the one hand thus could not be easily done as with the present, more loose assemblage, the over all length of which with the same number of keys have been shortened considerably and may be easily folded into the hand and the keys positioned for easier reach of and selection by the thumb and forefinger of the same hand.

The externally-threaded depending tubular portion 26'' provides for the detachable connection, say, vehicle or auto keys 31' or such keys that often need to be easily separated from the other keys carried by the support bar 26. Instead of the car keys 31 being directly connected by the link 34 to the key support bar 26, auto key 31' is detachably connected by the internally-threaded cup 27 that is detachable from the depending tubular portion 26'' of the support bar 26 by backing the cup off from the tubular portion threads. The detachable cup 27 is dished at its bottom and provides a central hole 27' to swivelly accommodate the circular bent head 34' of the link 34 to which a key clip 36 is secured by the upsetting lower end 34'' of the link shank after assembly of the parts. This clip 36 on the detachable threaded cup 27 can contain the two of usual auto or car keys 31'. With this arrangement the car keys can be readily separated from the total assemblage for whatever reason that may seem necessary at one time or another as when a car has to be parked with the keys left therein or when delivered to a garage for fixing. The remainder of the assemblage bearing house, office and other keys can be taken away for their use.

In FIGS. 1, 2, 4 and 5 are enlarged showings of the ring head portion 21 to illustrate what can be done with the head 21 to give additional features to the assemblage. In my above mentioned U.S. Pat. No. 3,804,307, the ring head portion contained a flashlight assembly which lends much to the entire key and ring assembly as the ring head with a flashlight fixed to the finger, the loss of a flashlight is prevented and in a natural location on the finger to help align the key with a key hole at night and in dark places. Thus, by a single finger of the hand, a flashlight as well as the keys are held to leave both hands and arms available to hold packages while unlocking a door in either a lighted or a dark place.

As seen in FIGS. 1 and 2, one use of the ring head portion 21 is to provide a coin dispenser opening 21' with a top inwardly extended peripheral coin-retaining ledge 21'' to normally hold a coin 37 such as a dime in a horizontal position upon a centrally-raised portion 38, over which the coin 37 can be tilted in the opening 21 by finger 39 to dotted line position 37' out from under peripheral ledge 21'' as illustrated thereby to release the coin 37 and render it easily available for toll, car fare or toilet locker. By making the opening 21' deeper several coins or tokens can be stacked therein and released in the same manner, one at a time.

In FIGS. 4 and 5, the outer face of the ring head portion 21 is left flat and a combined hanger and pocket spring clip piece 41 is secured thereto intermediate its length by a round headed screw 42. On the upper end of the piece 41 above the screw 42 is a flattened flared outwardly bent hanger portion 41' having a central hole 43 to receive a wall hook 44 threaded into a wall 46 as seen in FIG. 6. The lower end of the combined end piece has a spring pocket clip portion 41'' with an enlarged bottom, centered, arcuate formation that can ride down over a top edge of a partition 47 of a ladies handbag 48 with a handle 49 thereby rendering the finger ring key assemblage readily accessible and removable for fitting the ring 20 to a finger third 51' of right hand 51 in the manner being illustrated in FIG. 8 by left hand 50. In both mountings, the ring itself will extend horizontally while by virtue of the swivel connection provided by the ball headed swivel link 24 with the ring band and to the transverse key support bar 26 and keys 31 themselves will hang vertically from the ring band and downwardly parallel to the wall 46 of FIG. 6 or bag partition 47 of FIG. 7. The arcuate clip end formation 41'' is outwardly raised and laterally extended to allow but little tilt and stabilize the connection of the ring upon the wall hook 44 and against the wall 46 so that the keys 31 will be kept from drooping down the wall surface and to allow the hand finger to extend behind them for a good grasp upon the keys when lifting the ring key assemblage from the hook 44.

In FIG. 8, an illustration is made, once the ring and key assemblage is taken from the wall hook or handbag, how the assembly is thrust by left hand 50, assuming the person is right handed, onto the third finger 51' of the right hand up beyond the intermediate knuckle joint thereof with the left end of the key support bar 26 lying under the forefinger 52 and the right end of the key support bar 26 lying under fourth finger 53 whereby to keep the support bar and keys from tilting laterally relative to the bottom of the ring band 22 and the ring 20 against rotation while upon the third finger 51', the forefinger and the fourth finger upon being closed toward the third finger 51', thereby being wedged into spaces between the ring band and bar to steady and control the bar.

The diameter of the ring band 22 should be such as to permit the ring to slide rather loosely over the knuckle joint although if the link clamp, swivel link, support bar and keys are to be assembled by a spring clamp to any ornamental ring 20' one would be wearing as shown in FIGS. 13 and 14, and normally worn upon the third finger 51' or other finger, with a more tight fit of the ring can be permitted upon the finger. A loose ring can be kept upon the finger by folding down the outer end of the finger. With ball swivel connections being used, the key assemblage can in the above setforth manner be easily folded into the palm of the hand from the ring and carried with further safety therein.

It should be noted in FIG. 8 that with the swivel link connections now provided in this present assemblage over the relatively rigid assembly of my above mentioned patent, permits the assemblage to swivel and fold into the hand, the stem 24 carrying the support bar 26, bottom links 34, clips 36 and keys 31 that depend in overall length but a short distance down from the third finger and the ring thereupon and can upon curling the fingers of the hand be just about fully grasped and hidden within the palm of the hand with the closing of all fingers and thumb 54 of the right hand thereover. There is thus little chance, if any, of the keys being dropped as when rushing with packages to a door and with keys in the hand.

When arriving at a door 56 as shown in FIG. 9 with the keys 31 upon the hand and hanging with but a short span, the top key handle of a desired key 31 can be readily selected from other keys by reaching with forefinger 52 and thumb 54 of the same hand, all without the use of the fingers of the left hand and laying down or dropping bundles being carried. The easy forward swivel action of the swivel stem link 24, key support bar 26, swivel key links 34, clips 36 and keys 31 and 31', and by some forward tilt of the ring band 22 of ring 20 upon the finger 51', the selected key 31 can be simply and comfortably aimed at the keyhole lock opening 37 of a tumbler lock 57 in a plate 58 in door 56 and when fully thrust thereinto turned with the same hand, finger and thumb to unlock the door 56 and all without the prospect of dropping or losing the key assemblage or dropping bundles being carried at the time. Once the door is opened, the key 31 can be just as easily withdrawn from the lock 57 with the same hand and without dropping the keys or bundles. Once beyond the door and the bundles deposited inside the house, the ring assemblage can be taken from the third finger 51' with the left hand and returned to the handbag partition 47, clipped over its top edge thereof, FIG. 7, or hung upon the wall hook 44 in the house, FIG. 6, and thereby made easily accessible for further use at another time.

This key assemblage can take several forms and these other forms will now be described in connection with the other Figures of the drawing. These further forms or modifications are designed to be used with any normal finger ring that one may wear on a third finger and the swivel connection of the key support bar to the ring being simple, easily attachable to the ring band thereof. In the main, the modifications are to be made more simple, of less expensive construction and of standard stock pieces rather than of molded parts.

In FIGS. 10 and 12, the swivel connection is effected by means of a tension coil spring 61 of FIG. 11, that is loosely connected by a lateral spring end coil formation 62 wound onto the ring band 22 of ring 20 and by an end coil 63 similarly connected to a top central loop formation 64 of a key support bar 66 that is formed of wire, FIG. 10. This bar wire is coiled also to provide four depending loop formations 67 spaced from one another and from the top loop 64 and with two loops 67 at each side thereof. The bar wire is of sufficient diameter section and resilient but of sufficient stiffness to keep it in shape. By the use of this especially prepared extension tension spring connection 61, FIG. 11, the spring and support bar parts can be easily assembled upon one another and upon the ring so as to have swivel action and extension movement found necessary for the above-mentioned functioning and easy use of the assemblage. The ring band 22 will be slipped over a finger such as the third finger 51' of right hand 51 and stabilized to be held in a horizontal position by the forefinger 52 and fourth finger 53, at each side thereof. The forward stretch of the spring 61 will inherently permit the necessary forward thrust of the key when grasped by the forefinger 51' and thumb 54 and at the same time provide the swivel action needed for the support bar relative to the ring band 22. The overall number of parts has been lessened and all the ball joints of the prior forms eliminated by this form of the invention. The ball links 24 and 34 of the first form of the invention shown in FIGS. 1 and 3 have thus been eliminated. Key clips 68 that will contain keys 31 are clipped directly through the depending loops 67 of the support bar 66.

The respective opposite ends of the looped wire key bar 66 are threaded as indicated at 71 and 72 and to which internally-threaded loop nuts 73 and 74 are respectively detachably connected. Retaining links 76 and 77 are clipped on the respective loop nuts 73 and 74 and key clips 68' are secured thereto by upsetting shank ends of the links 76 and 77 respectively to provide enlargements 76' and 77' like with links 34 in FIG. 3, to hold the special keys, such as car keys, clipped thereto and thus made easily detachable from the whole key assemblage as is removable ball cup 27 of the first form of the invention. It should now be apparent that with the forms of the invention of FIGS. 10 and 12, the keys 31 can be easily selected by thumb and forefinger when the ring is on the hand finger in the manner described in connection with FIGS. 8 and 9. This latter form of FIG. 10 thus can have detachable keys as for two different cars, one set on each end of the support bar 66.

In FIG. 12, there is shown still another form of the invention in which the tension connection spring 61 of FIG. 11 is used for the connection between ring band 22 and a key support bar 81, that is formed of strip stock rather than molded as in the first form of the invention, but with no provision for easy detachment of special keys. The keys will all be attached by round headed swivel links 82 like the links 34 of FIGS. 1 and 3, lying in depressions 83 and permitted to swivel relative to the key bar 81 to assist with the placing of a selected key in a keyhole with the thumb and forefinger of the one hand on which the assemblage will be similarly carried by the ring 20 on a third finger as illustrated in FIG. 9.

The strip or key support bar 81 is flat on both top and bottom faces with the rounded dished openings or depressions 83 spaced equally from one another on the top face and similar to the openings 32 of bar 26 as shown more clearly in FIG. 3. Depending from the respective dished openings 83 are respectively the oversized central holes to accommodate the shanks of the round headed links 82 so that top round heads 82' of the link 82 can freely swivel with key clips 84 free on the end of link 82 and held against vertical displacement therefrom by the upset lower end 82'' of the link 82. The key 31 is snapped into clip 84 through clip opening 84' and depends therefrom. The lower end 63 of tension spring 61 is connected to round head 82' of the intermediate swivel link 82 so that this one link 82 of the assemblage serves a double purpose, one purpose to hold the key clip 84 and a key 31 on the support bar 81 and the other purpose to provide for the connection of the bar 81 to loop end 63 of tension spring 61. This form of FIG. 12 may still have its finger ring 20 placed upon the third finger, and the key selected with the thumb and forefinger, as permitted by the stretch of spring 61 for insertion of a selected key 31 into a keyhole opening 37, FIG. 9, all in the manner as set forth above. The spring 61 provides all of the swivel action as well as extension needed to place the key in the keyhole while the ring is on the finger and upon the key being released from finger and thumb will retract the key assemblage into the hand.

As will be seen in the form of the invention shown in FIGS. 13 and 14, a key assemblage resembling more closely that of the first form of the invention but made more of standard stock material pieces instead of the key support bar being molded and one which has a spring clip 91 that can be easily snapped on and off the band 22' of a key ring 20' that would be worn all the time and the key assemblage itself would simply be without the ring but merely snapped onto its band to prevent release as loss from the one hand.

The spring clip 91 is folded into rectangular section and will be made of spring metal or plastic. It has a depressed bottom portion to provide a ball socket formation 91' in which is seated a half-ball head 92' of a swivel stem or link 92 that extends up through an oversize hole that allows the link 92 to freely swivel and tilt. This clip 91 has a flat top portion **91*a* that overlies bottom socket portion 91*b* and these two portions are joined and spaced at one side by an integral intermediate portion 91*c* so that the top and bottom portions 91*a* and 91*b* can be spread or spring as illustrated in FIG. 14 to open and to clip them over the ring band 22'. The opposing top and bottom portions 91*a* and 91*b* have inwardly inclined lips to facilitate the starting of the clip 91 over the edge of the ring band and when the clip is fully snapped onto the ring band 22' the lips securely keep the clip 91 in place thereon and against easy displacement therefrom. The key assemblage not including the ring band as with the form of FIGS. 1 and 3** and allows ordinary classic ring ordinarily being worn by one, to be used. You simply clip the assemblage to your regular ring, ordinary or classic, that you are wearing.

A key support bar assembly 93 will depend from the clip 91 by the double ball swivel link 92 having the half-ball head 92' and the lower full head 92'' to give free swivel movement. A flat key support bar 95 has intermediate its length a threaded hole 94 in which there is threaded an externally-threaded sleeve 96 having an internal diameter adapted to loosely receive the stem ball head 91 that seats in an inverted socket cup 97 threaded down over the upper end of the threaded sleeve 96 tightened will hold the ball end 92'' of link 92 for swivel movement within a top enlarged hole of the cup nut 97. The half-ball head 92' of link 92 will be formed upon the link shank extended into an enlarged opening in the clip bottom **91*b* and swaged or upset to form the upper half-ball head upon the link 92. The link 92 can swivel but it will be held in the socket 91' against upward movement when the clip 91 is forced onto the ring band 22' by the bottom face of the band. There is enough play in the socket connections of the link 92 to allow the captured key support bar 95 to be substantially angled or tilted with respect to the ring 20' and positioned to allow a key 31 along the fingers when taken with the loose connections of the key to the support bar 95**.

Keys 31 are connected by the same key clips 68 and links 34 of the first form of the invention and the links 34 in turn connected to the support bar by their coiled swivel heads 34' that lie in spaced dished depressions 98 in the bar 95 with their shanks extending loosely through central holes in the bar extending down from the depressions 98 and the link shanks extending down through the top of key clips 68 and the shank end upset to provide the enlargement 34'' to retain the clip 68 upon the link shank.

The middle key clip 68 is detachably connected to the depending end of threaded sleeve 96 by an internally-threaded cup 99 containing the large ball head 99' of a link 99*a*. The car key 31 can be detached by unscrewing the cup 99 as described above for the first form of the invention as shown in FIG. 3. Accordingly, there has been provided with this latter form of the invention of FIGS. 13 and 14, an assemblage in which the support bar 93 and threaded sleeve 96 can be made from standard stock pieces, without need for being molded and when machined and fashioned can be readily assembled or released by a clip 91 releasably attachable to the ring normally worn upon the finger without especially providing the assemblage with a ring part. The clip 91 can be released from the ring band 22 by a knife blade or key that can be inserted between the internal hook like lips and twisted to separate them so that the assemblage can slide off the side ring band.

In FIGS. 15 and 16, a complete key assembly is shown in which a button, disk or clip with a small ball chain suspended therefrom is used in lieu of the ring to keep the key assemblage fastened to the fingers while permitting the use of the full open hand to carry packages and to free the forefinger and thumb to select a key from the assemblage. This form of the invention can be made from stock pieces and there will be no need for molding operations. A small ball chain with its clasp and normally used for keys forms a part of the assemblage.

A button, disk or in this instance, a coin clip 101 being of a size of to accommodate a twenty-five cent coin piece C is adapted to overlie the top surfaces of adjacent fingers 102 and 103 of a hand 104. This clip 101 is formed of a sheet metal strip bent over upon itself to provide a top part 106 that tightly carries on its top surface a half circular flanged shape 107 to accommodate a coin piece C for decorative as well as for coin availability purposes. An open fold 108 attaches a bottom part 109 to the top part 106 to complete a clip adapted to be fastened over a pocket edge and has a turned down starting lip 111 to facilitate the connection with the pocket edge or belt edge, see FIGS. 19 and 20. The bottom part 109 of the clip 101 has an elongated slot 112 that starts with an enlarged circular end 113 adapted to receive a ball 116' of a small length of ball chain 116 so that the chain can be slid down to the inner end of the slot 112 and terminating at the center of the clip in a depression 114 of the bottom part 109. As best seen in FIG. 18 the side of the slot 112 has an inwardly-extended hook portion 117 to keep the key chain 116 from sliding up the slot 112 and dropping out of the enlarged circular open end 113 of the slot 112. This same circular open end 113 can serve for hanging the assembly on a wall hook as illustrated in FIG. 21.

The short ball chain 116 is only of such length as to extend downwardly between the fingers 102 and 103 of hand 104. FIGS. 15 and 16 so that a transverse key support bar 118 fastened to the lower end of chain 116, in a manner to be described, will lie substantially flush to the lower faces of the fingers 102 and 103 and provide for a close and safe squeeze fit of the assemblage upon the fingers and the bar 118 sustained against easy turning and allow easy selection of a key thereon with the thumb and forefinger. With the keeping of the fingers 102 and 103 squeezed upon the chain 116, the key assemblage is kept safely attached to the hand as with the ring and with little possibility for a loss of the assemblage.

On the lower end of the short chain 116 is a typical double clasp 119 for joining two ends of a ball key chain together. This clasp is split along one side at 121 and this split is provided with an enlarged hole 121' therealong for receiving bottom ball 116'' of the chain 116. The clasp 119 also has threads 121'' on its exterior surface matching with internally-threaded hole 118' of the support bar 118. The hole 118' in bar 118 is undersize so as to give a tight fit of the clasp 119 within the hole 118' to keep the enlarged hole 121' of the clasp 119 aligned with the side wall of the bar threaded hole 118' and the chain bottom ball 116'' against escape from the support bar 118. Thus, the key support bar 118 is suspended from the disk clip 101.

The lower end of the ball chain fastener 119 is depended from the underside of the key support bar 118 and similarly supports a detachable ball 122' of a ball link 122 that is upset at 122'' to support an automobile key clip 123. Threading down the fastener 119, the key clip 123 with an automobile key 123' can be detached from the assemblage so that the remainder of the assemblage can be taken away for use with house keys. The attachment of the automobile key to key support bar 118 can be made in the reverse manner.

At the opposite sides of the key clip 123 and clasp 119 on bar 118, provision is made for a swivel assemblage of key clips 125 and 126 to the bottom face of the key support bar 118 as best seen in FIG. 22, this bottom face of the bar 118 being provided with upwardly-extended hollowed openings 127, two at each side. A small elongated hole is extended into each end of the support bar 118, one at 128 and the other at 129, and intersecting the two upward openings at each side of the bar 118. The holes 128 and 129 are threaded at their inner ends to secure the threaded ends of pin screw rods 132 and 133. These pin rods extend through the upper ends of S-shaped links 134 and to the lower end of these links 134, loops 136' of depending links 136 are loosely attached. The key clips 125 and 126 are held upon the lower ends of the links 136 by their upset lower shank ends 136''. The full assemblage has now been described. It should be seen that when the assemblage is held between the fingers 102 and 103 as shown in FIG. 15 that a key 123' can be easily selected with the thumb 105 and forefinger 102 of this same hand. Adequate flexibility and swivel movement is provided by the ball chain 116, links 134, 136, key clips 125, 126 and the normal loose connection of the keys 123' to the key clips.

In FIG. 19, it is illustrated how this assemblage can be suspended from a button hole 137 in a side pocket flap 138 of a suit coat by its disk clip 101 in the manner a button would be extended through the hole. In FIG. 20, a long ball chain 139 is substituted for the short chain 116 to adapt the assemblage to place the keys in a side trouser pocket 141 while the disk clip 101 is fastened to the top edge of trouser belt 142. As stated above and as shown in FIG. 21, the assemblage can be hung upon a wall hook 143 by the disk clip 101. The enlarged end hole 113 of the slot 112 in the bottom part 109 of the disk clip 101 of the assemblage receives the upper end of the hook 143.

It should now be apparent that there has been provided key assemblages that are more easily manipulated while attached by a ring on a finger of the hand or a disk with depending chain squeezed between two fingers to prevent the assemblage from falling from the hand when the assemblage is being carried to a location to open a door thus leaving this hand and arm free to carry bundles without threatening possible loss of the keys. It would be further apparent that while on fingers and still with bundles in the arm, a single key on the depending key assemblage can be easily selected and grasped by the forefinger and thumb of the same hand and extended into the keyhole. The key assemblage is so assembled and attached to the fingers that it can swivel, be folded and gripped in a closed hand and its overall depending length short enough in which to keep the individual keys well within the easy reach of the thumb and forefinger when suspended from the fingers. Also, it should be apparent that the assemblage has detachable means for the detachment of certain keys from the assemblage for separate use as car keys so they can be left with the car and the person take the main body of the keys with them.

This assemblage not only is a novelty but a necessity, the same as an original or ordinary key ring containing keys to prevent loss while using them. The assemblage has particularly use in the dark when one cannot afford to drop keys when hurrying to his home or abode and thereby helping to secure his or her safety. It is not unusual for one to slip his finger into an ordinary oversized key ring but you cannot be sure that it would not get released as one still has to take such key ring off the finger to locate or use a key. With the present invention flexibility has been provided such that a key can be now easily reached while a ring fitting the finger will be kept upon the finger. The disk and chain will similarly be safely held but between the fingers.

While various changes may be made in the detailed construction, it shall be understood that such changes shall be within the spirit and scope of the invention as defined by the appended claims.

What is claimed is:

1. A finger-retained key-holder assemblage comprising finger-retaining means adapted to be fitted to the fingers of a hand to permit the assemblage to be dangled from and carried by the fingers without being gripped by the hand, a tranverse key support bar extending more than the width of one finger and adapted to be leveled and gripped therebelow by the fingers against the palm of the hand, said finger-retaining means including a member embracing the top of the fingers and flexible and swivel means for connecting the key support bar to the finger embracing member to hold the key support bar closed upon the underfaces of the fingers and foldable rearwardly into the palm of the hands outwardly thereof along the fingers, means for respectively loosely connecting the respective key supporting clips to the key support bar to normally dangle loosely therefrom, said key clips with the keys all being foldable into the palm of the hand or extendable along the underfaces of the fingers of the hand, the overall height of the assemblage with keys on the clips and when attached to the fingers being such that the keys may be easily reached and grasped by the thumb and forefinger of the same hand from which the assemblage is being carried by the fingers, said fingers embracing member being a ring adpated to be fitted to the third finger of the hand, said flexible and swivel means for connecting the transverse key support bar to the ring comprising a socket attachment connected to the bottom of the ring band, a link of about the height of the finger thickness having an upper ball head swivelly carried by the ring band socket attachment and loosely depending therefrom, said transverse key support bar having a ball socket attachment and loosely depending therefrom, said transverse key support bar having a ball socket formation and said line having a ball head on its lower end seated in the support bar socket formation to swivel relative thereto.

2. A finger-retained key holder assemblage as defined in claim 1 and said support bar depressions with oversize central holes spaced along its upper surface, said means for connecting the key clips to the key support bar comprising individual links depending downwardly through the spaced depressions and from the underside of the key support bar, each link having a rounded head to swivel in the depressions and a shank depending therefrom, said links respectively having their shanks extending down through the central holes of the bar depressions with their heads lying therein to swivel with respect to the bar, each key supporting clip having a hole therein, the shanks of said links extending loosely through said holes in the clips and headed on their respective lower ends to retain the key clip from detachment therefrom while allowing the key clip to swivel upon the link as well as the clip link may swivel upon the key support bar or the key with respect to the key clip.

3. A finger-retained key holder assemblage as defined in claim 2 and said key support bar having an externally-threaded depending sleeve projection axially aligned with the key support bar ball socket formation and with the sleeve hole terminating upwardly into the bar socket formation to permit the assemblage of the link for the connecting of the support bar upwardly through the sleeve hole to the ring band socket attachment confining the link lower ball head with the bar ball socket formation, a removable cap threaded upon the bar depending sleeve projection and having a socket formation thereon, one of the key clip links having its rounded head confined in the depending cap socket formation and its shank depending from the cap and having one of the key clips loosely secured to the lower end of its shank, said last mentioned key clip, link and ball cap being removable together to separate a key or keys connected to that clip on the threaded cap from the rest of the main assemblage of the keys.

4. A finger-retained key holder assemblage comprising finger-retaining means adapted to be fitted to the fingers of a hand to permit the assemblage to be dangled from and carried by the fingers without being gripped by the hand, a tranverse key support bar extending more than the width of one finger and adapted to be leveled and gripped therebelow by the fingers against the palm of the hand, said finger-retaining means including a member embracing the top of the fingers and flexible and swivel means for connecting the key support bar to the finger embracing member to hold the key support bar closed upon the underfaces of the fingers and foldable rearwardly into the palm of the hands outwardly thereof along the fingers, means for respectively loosely connecting the respective key supporting clips to the key support bar to normally dangle loosely therefrom, said key clips with the keys all being foldable into the palm of the hand or extendable along the underfaces of the fingers of the hand, the overall height of the assemblage with keys on the clips and when attached to the fingers being such that the keys may be easily reached and grasped by the thumb and forefinger of the same hand from which the assemblage is being carried by the fingers, said flexible and swivel means for connecting the transverse key support bar to the ring band comprising a stretchable tension coil spring having rolled-up clip ends for loose attachment of the spring respectively to the finger retaining means and to the key support bar.

5. A finger-retained key holder assemblage as defined in claim 4 and said transverse key support bar being in the form of a wire formed to have a single coil loop on its top side and plurality of coil loops on its bottom side, the one rolled-up clip end of the tension coil spring being connected to the top side coil loop of the wire bar and key clips attached directly by their key opening respectively through the respective bottom side coil loops and adapted to contain the keys for the assemblage.

6. A finger-retained key holder assemblage as defined in claim 5 and at least one end of the wire key support bar being threaded, a nut with a loop formation thereon removably threaded onto the threaded wire bar end, a key clip attached directly to the loop formation of the loop nut, said key clip and loop being removable together to separate key or keys from the wire key support bar.

7. A finger-retained key holder assemblage as defined in claim 4 the top said transverse key support bar being in the form of a flat strip having a series of swivel depressions and central holes spaced therealong, individual links respectively depending through the respective swivel depressions and central holes, each link having a rounded loop head to conform to the swivel depression and a shank extending loosely through the central hole thereof, key clips having holes and respectively loosely receiving the shanks of said links, said link shanks being upset to hold the key clips of the tension spring being attached to the transverse key support bar being connected to the rounded loop head of an intermediate key clip link to hold the transverse support bar.

8. A finger-retained key holder assemblage as defined in claim 1 said transverse key support bar having a threaded hole extending therethrough intermediate its length, an externally-threaded sleeve extending through said threaded hole to extend above and below the top and bottom surfaces of the band, a link having a swivel-like head in said socket attachment of the ring band and depending downwardly therefrom and having a ball head on its lower end, a top internally-threaded socket cap receiving the lower ball head of the link and threaded down over the threaded sleeve at the top of the support bar to attach the lower ball head of the link thereto, and a bottom internally-threaded removable socket cap containing the swivel-like head of the intermediate key clip link threaded to the depending end of the externally-threaded sleeve for removal of depending keys on its clip from the key assemblage to separate them from the other keys of the assemblage.

9. A finger-retained key holder assemblage as defined in claim 1 and said socket attachment being a normally worn ring and being in the form of a spring clip adapted to be detachably thrust sideways onto the ring band, said attachment having a bottom portion with a socket formation therein and a top portion interconnecting at one side with the bottom portion, said bottom socket formation loosely receiving the upper head of the swivel link, and an assembly slot extending along the opposite side of the band-receiving socket attachment end to fit over the opposite side of the band, opposing inwardly turned lips making up the assembly slots as the spring clip is forced sideways over the ring band and serving to normally restrain the socket clip against lateral displacement therefrom, the top and bottom clip portions being capable of being sprung when desired to remove the key assemblage from the finger ring.

10. A finger-retained key holder comprising finger-retaining means adapted to be fitted to the fingers of a hand to permit the assemblage to be dangled from and carried by the fingers without being gripped by the hand, a transverse key support bar extending more than the width of one finger and adapted to be leveled and gripped therebelow by the fingers against the palm of the hand, said finger-retaining means including a member embracing the top of the fingers and flexible and swivel means for connecting the key support bar to the finger embracing member to hold the key support bar closed upon the underfaces of the fingers and foldable rearwardly into the palm of the hands outwardly thereof along the fingers, means for respectively loosely connecting the respective key supporting slips to the key support bar to normally dangle loosely therefrom, said key clips with the keys all being foldable into the palm of the hand or extendable along the underfaces of the fingers of the hand, the overall height of the assemblage with keys on the clips and when attached to the fingers being such that the keys may be easily reached and grasped by the thumb and forefinger of the same hand from which the assemblage is being carried by the fingers, said finger embracing member being a disk, a ball chain carried by the disk and depending between the fingers when the disk overlies the top of same, said ball chain being about the length of the thickness of the fingers, said key being attached to the transverse key support bar whereby when the fingers are squeezed upon the ball and between the disk and the key support bar, the key assemblage will be tightly retained upon the ball chain and between the disk and key support bar, the key assemblage will be tightly retained upon the fingers of the hand.

11. A finger-retained key holder assemblage as defined in claim 10 and said button-like disk being the form of a spring clip having top and bottom portions folded upon one another, the bottom portion having a slot and socket for receiving one of the balls of the ball chain, said key support bar having a threaded hole extending through the top and bottom, a slitted ball chain fastener receiving the lower ball of the chain and having mating threads with thread hole to maintain the assembly of the ball chain with the key support bar.

12. A finger-retained key holder assemblage as defined in claim 11 and a ball link detachably seated in the lower end of the ball fastener and depending from the key support bar and a key clip depending from said link.

13. A finger-retained key holder assemblage as defined in claim 12 and said key support bar having spaced upwardly extending openings in the underface thereof and lying in pairs at opposite sides of the assembled ball fastener on the bar, said means for loosely connecting the key clips to the key support bar including wire links supporting the key clips and having loop ends extending respectively into the upward openings in the support bar, and pin rod means extending from the opposite ends of the key support bar and intersecting the openings and the link loop ends therein whereby to retain the links loosely upon the key support bar.

* * * * *